US005186630A

United States Patent [19]

Tien

[11] Patent Number: 5,186,630

[45] Date of Patent: Feb. 16, 1993

[54] UNIVERSAL SUN-PATH DIAL

[76] Inventor: Li Chiu Tien, 4412 Huron, Midland, Mich. 48642

[21] Appl. No.: 774,041

[22] Filed: Oct. 7, 1991

[51] Int. Cl.[5] ..... G04B 19/22

[52] U.S. Cl. ..... 434/149; 434/402; 434/284

[58] Field of Search ..... 434/111, 149, 402, 404, 434/405, 284, 285, 289, 290, 276

[56] References Cited

U.S. PATENT DOCUMENTS

| | | | |
|---|---|---|---|
| 990,764 | 4/1911 | Morse | 434/284 |
| 2,440,827 | 5/1948 | Marean et al. | 33/270 |
| 2,715,273 | 8/1955 | Dodd et al. | 33/1 SC |
| 3,290,799 | 12/1966 | Eisenhauer | 434/111 X |
| 4,012,851 | 3/1977 | Eisenhauer | 434/111 X |
| 4,083,121 | 4/1978 | Eisenhauer | 434/285 |

FOREIGN PATENT DOCUMENTS 0008923 of 1913 United Kingdom .

OTHER PUBLICATIONS

C. Bernasconi, "Percorsa apparente del Sole nel cielo locale", Geofisca vol. 29, No. 1, pp. 39–51 (1988).

*Primary Examiner*—L. Gene Mancene
*Assistant Examiner*—Neffrey A. Smith

[57] ABSTRACT

The invention described herein is a mechanical device that appearing uncrowded with lines, numbers, and other markings, depicts the sun's daily path and gives sunlight information, for any interested latitude, date, and time.

A major dial is rotated on a base according to the latitude; a sun-path slider is slid on the major dial according to the date. Then the device depicts a two-dimensional, elevation view of the sun's daily path, as a straight line, through all or some of these five zones in the sky: direct sunlight; civil, nautical, and astronomical twilights; and night.

The depicted sun's daily path gives the following sunlight information: the directions and times of sunrise and sunset; the times of the beginnings and endings of the twilights. On the depicted sun's daily path, the sun's position, indicated by a sun-position slider according to the time, gives solar energy quantities and the sun's angular height on the base and the sun's direction on a minor dial.

21 Claims, 6 Drawing Sheets

UNIVERSAL SUN-PATH DIAL

BACKGROUND OF THE INVENTION

1. Field of the Invention

This invention relates to machines for a two-dimensional depiction of the sun's daily path and for information on sunlight, such as the times of sunrise and sunset and solar energy.

2. Description of the Prior Art

Understanding how the sun's apparent motion and sunlight change with location, season, and time is of interest for basic knowledge, science education, and practical use. Machines can be built to aid the understanding, based on the known fact that these five quantities are interrelated: the sun's angular height, the sun's direction, latitude, date, and sun time, which is independent of longitude and is 12 noon when the sun is highest in a day. Any three of the five quantities determine the remaining two.

Armillary spheres of antiquity composed of rotatable rings have the capability of demonstrating the sun's daily path and indicating the sun's angular height and direction, for any latitude, date, and time.

Computers and other electrical machines can also achieve said capability but cannot directly reveal how they function.

Comparing with armillary spheres and electrical machines, flat, two-dimensional and nonelectrical machines with said capability seem to be potentially less costly, more portable, and more direct in disclosing their working principle. Yet no flat machine with said capability is found described in the prior art. For example, U.S. Pat. No. 4,083,121, issued Apr. 11, 1978, describes a planisphere for stars but not for the sun's angular height and direction. U.K. Patent No. 8,923, accepted Nov. 20, 1913, describes a flat machine that gives the times of sunrise and sunset but again does not give the sun's angular height and direction The following three patents have some of said capability, in narrowed scopes.

U.S. Pat. No. 2,440,827, issued May 4, 1948, and No. 2,715,273, issued Aug. 16, 1955, describe a flat machine that applies to all dates but for only a fixed latitude, depicts a plan view of the sun's daily path, as a curve. The shape of the curve varies with date and latitude. U.S. Pat. No 990,764, issued Apr. 25, 1911 and titled Sun-Path Dial, describes a flat machine that applies to all latitudes but for only four fixed dates, depicts an elevation view of the sun's daily path as a straight line.

The present invention applies to all latitudes and dates by overcoming the following difficulties of the prior art.

The elevation view of the sun's daily path, as a straight line, shows the sun's angular height but conceals the sun's direction. It is unobvious how to find the sun's direction from the elevation view. It is also unobvious for a machine to give more information than the three patents last cited and yet not to appear crowded with lines, numbers, and other markings. It is again unobvious how to design components, of such a machine and how to fit them together. It is further unobvious that such a machine can be homemade from pieces of paper with needed markings, transparent sheets marked with only a few straight lines, and easily available material, such as card board and a thumb tack.

A recent Italian paper, "Percorso apparente del Sole nel cielo locale", Geofisco vol. 29, no. 1, pp 39–51 (1988) by C. Bernasconi, explains how to calculate the sun's angular height and direction and tabulates such sunlight information for only selected latitudes, dates, and times. This recent paper indicates that such sunlight information, readily obtainable from the present invention, is of interest but not yet readily available.

PURPOSE OF THE INVENTION

An objective of this invention is to provide a simple, flat, mechanical device for ready depiction of the earth's axis of rotation and the sun's daily path in an elevation view and for ready sunlight information, including the times of sunrise and sunset and the sun's angular height and direction, for any latitude, date, and time.

A further objective of this invention is to achieve the above and to provide additional sunlight information, without the device appearing crowded with lines, numbers, and other markings.

A still further objective of this invention is to achieve the above without requiring unusual material, except pieces of paper with needed lines, graduations, and numbers, so that the device can be homemade.

SUMMARY OF THE INVENTION

The present invention is a device comprising a base, a major dial, a sun-path slider, and a fastener. The device may also include a minor dial and a sun-position slider.

The device achieves the third objective through mechanical details to be shown in figures.

In essence, the device achieves the first two objectives as follows. The sun-path slider, with a straight line representing a depicted sun's daily path, is slidable on the major dial, which is rotatable on the base. The device is applicable to all latitudes and dates by rotating and sliding the depicted sun's daily path respectively according to latitudes and dates of interest. The date scale on the major dial is uncrowded by being circular. It happens that by being circular, the date scale has nearly uniformly distributed dates. In order to find the sun's direction hidden in an elevation view of the sun's daily path, the device uses a nonuniform angle scale, which is uncrowded. To facilitate reading the sun's direction, the minor dial is aided by aesthetic parallel and perpendicular lines, such as that furnished by a piece of pastel, cross-stitch fabric. The lines of the fabric do not appear crowded.

The base has a circle representing a depicted celestial sphere; a uniform angle scale on the perimeter of the circle; a straight line representing a depicted horizon; parallel lines representing depicted boundaries of civil, nautical, and astronomical twilights; and scales for solar energy quantities. The major dial has a straight line representing a depicted earth's axis of rotation, a date scale, and a time scale. The minor dial has a nonuniform angle scale graduated on a straight line. The sun-path slider slides on the major dial and has a straight line, representing a depicted sun's daily path. The sun-position slider slides on a component of the device and has a line for indicating the sun's position on the depicted sun's daily path.

The major dial and the minor dial are preferred to be transparent; the sun-path slider and the sun-position slider are transparent. As a result, lines, numbers, and other markings on overlaying components of the device mostly can be seen together as a group.

Additional features of the invention will appear in the following descriptions and claims.

Figure 1:
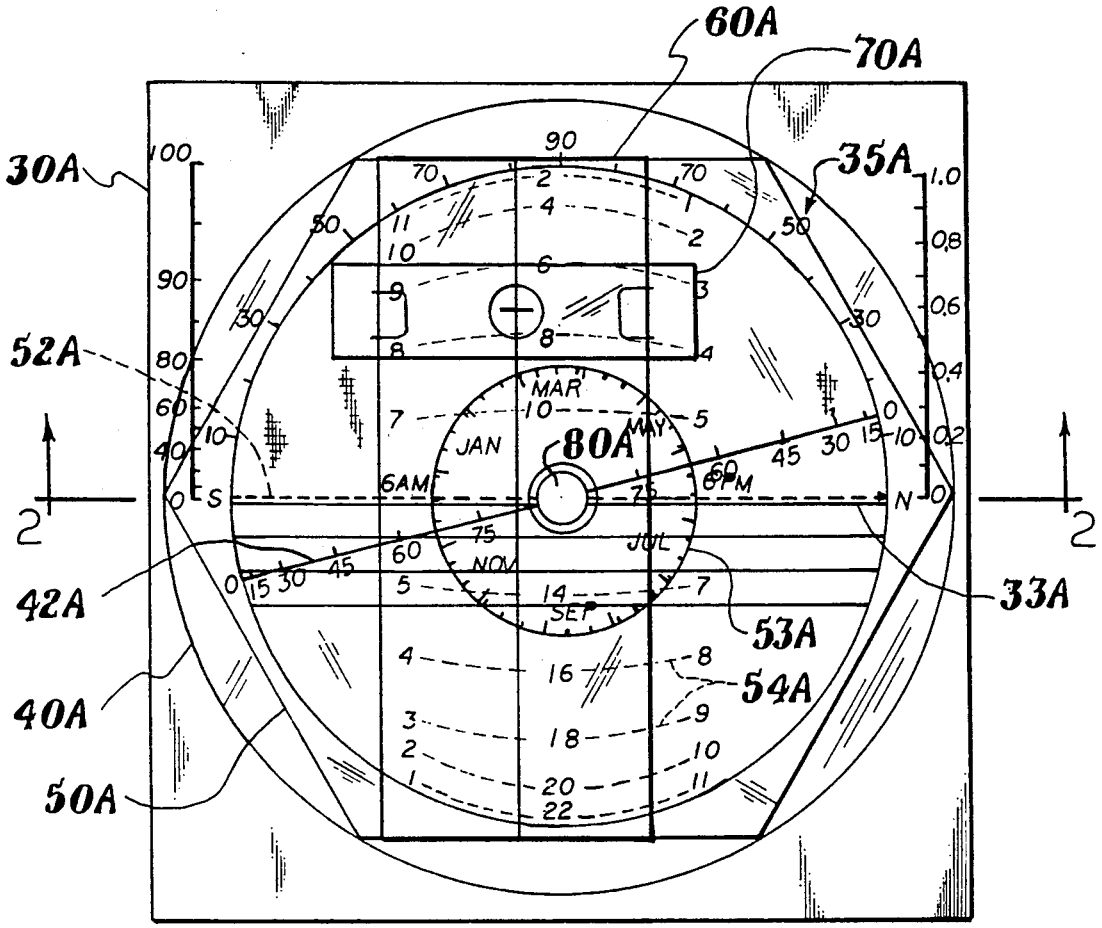
FIG. 1 is a plan view of a device A according to the invention.

Graduations and numbers of the scales of the device B are identical to those of the device A. For simplicity, graduations and numbers of the scales are shown only in FIGS. 1, 3, and 3A for the device A.

REFERENCE NUMERALS IN DRAWINGS

The numerals below followed by letter A refer to components and scales of the device A; those followed by letter B, components and scales of the device B:

30: base; on the base:

35: uniform angle scale

36-1: scale for approximate, maximum available solar energy

36-2: scale for an angle factor for solar energy reduction

40: minor dial; on the minor dial:

42: nonuniform angle scale

50: major dial; on the major dial:

53: date scale

54: time scale

60: sun-path slider

70: sun-position slider

80: and 81 fastener

With additional features, the base 30A of the device A becomes base 30-1A and base 30-2A. The device A further comprises a washer 44.

DESCRIPTION OF SPECIFIC EMBODIMENTS

Described here are, according to the invention, a device A and a device B, referring respectively to claims 10 and 16 to be stated. The device A is sturdier; the device B uses more readily available material and does not require graduations and numbers on transparent sheets.

Figure 2:
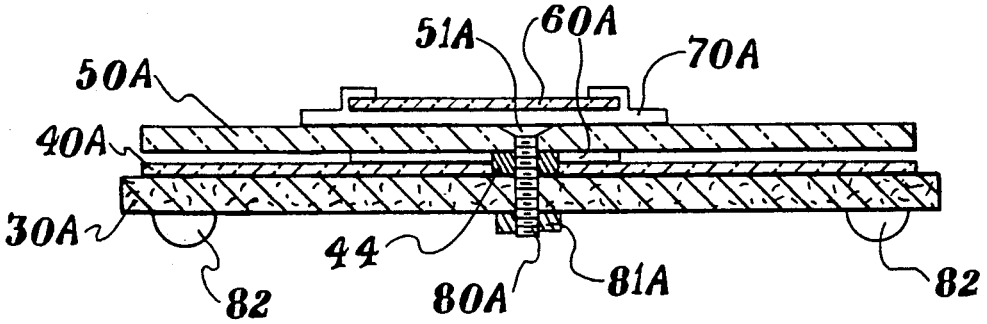
FIG. 2 is a side elevation view of the device A.

Referring to the drawings, FIG. 1 is a plan view of the device A; FIG. 2 is a side elevation view taken on line 2—2 of FIG. 1. The plan view of the device A in FIG. 1 is uncrowded with lines and scales, particularly when numbers for the scales can be made smaller than those in FIG. 1.

The device A comprises a base 30A in FIGS. 1 and 2. Upward from the base 30A, the device A further comprises a washer 44 in FIG. 4, a minor dial 40A in FIG. 5, a major dial 50A in FIG. 6, a sun-path slider 60A in FIGS. 7 and 8, and a sun-position slider 70A in FIGS. 9 and 10. All these components of the device A are also indicated in FIGS. 1 and 2. The device A comprises further a flat-head fastener, consisting of a flat-head screw 80A in FIG. 1 and 2 and a thumb nut 81A in FIG. 2.

For the device A, the base is made from a rigid sheet; the major dial, a rigid, transparent sheet; the minor dial, the sun-path slider, and the sun-position slider, thin, transparent sheets.

Illustrated in FIG. 2, the base 30A has short legs 82 underneath, for resting the device A stably on a fairly flat surface. The flat-head screw 80A and the thumb nut 81A hold together the base 30A, the minor dial 40A, and the major dial 50A. By loosening or tightening the thumb nut on the flat-head screw, the major dial can be rotated easily or be prevented from free rotation. The minor dial and the washer 44 for the former are assembled between the base and the major dial. Fitted around and thinner than the washer, the minor dial can be rotated easily, even when the thumb nut is tightened.

Figure 3:
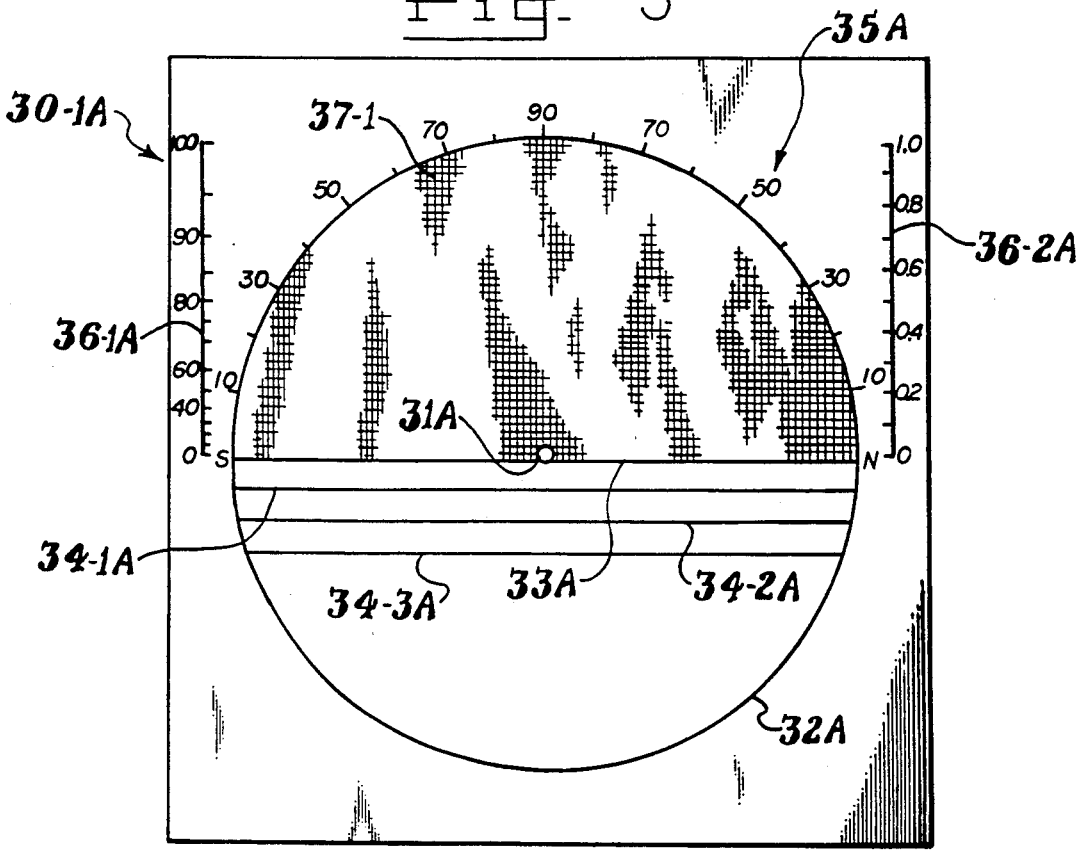
FIG. 3 is a plan view of a base 30-1A of the device A.
Figure 3A:
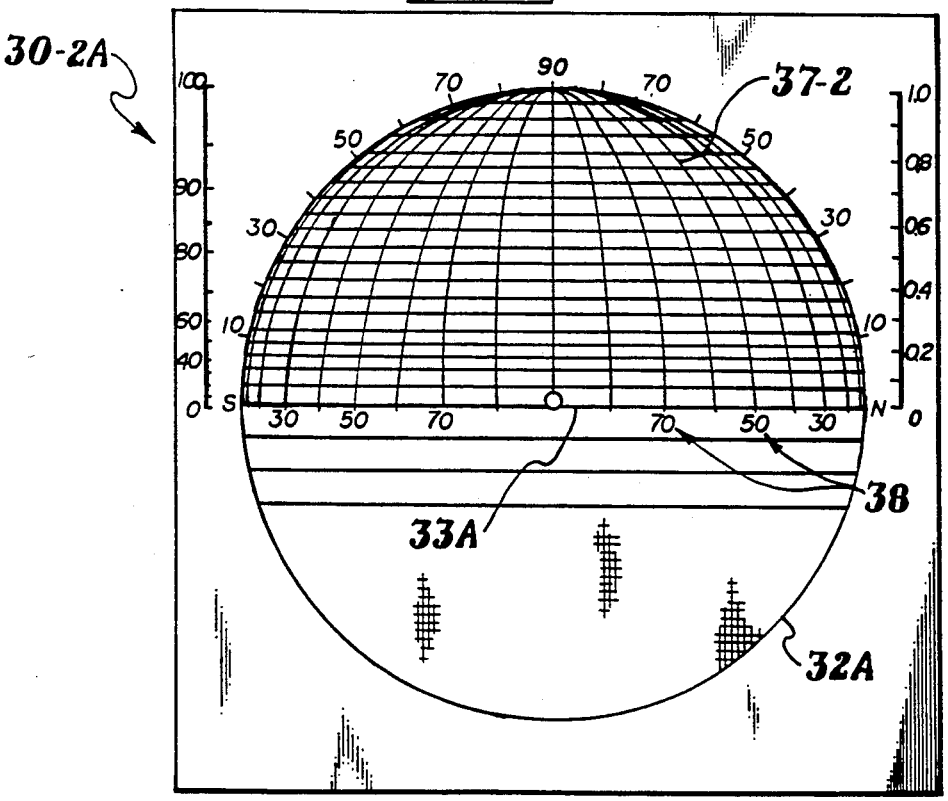
FIG. 3A is a plan view of a base 30-2A of the device A.

A base 30-1A in FIG. 3 has systems of lines 37-1; a base 30-2A in FIG. 3A has systems of lines 37-2. The rest of 30-1A and 30-2A are identical to the base 30A in FIGS. 1 and 2.

Illustrated in FIG. 3, the base 30-1A has a round hole 31A to fit the flat-head screw 80A; a circle 32A, centered around 31A, representing a depicted celestial sphere; straight line 33A representing a depicted horizon; parallel lines 34-1A, 34-2A, and 34-3A representing depicted boundaries of civil, nautical, and astronomical twilights; a uniform angle scale 35A on the perimeter of the circle; scales for solar energy quantities, comprising scale 36-1A for approximate, maximum available solar energy and scale 36-2A for an angle factor for solar energy reduction; and an additional feature, aesthetic systems of lines 37-1, parallel and perpendicular to the depicted horizon 33A. The systems of lines 37-1 can be furnished by a piece of pastel, cross-stitch fabric. The unmarked portion and the back of the base may be imprinted with maps of large areas of interest and marked with latitudes and longitudes, for estimating latitudes and longitudes of places in the areas. Latitudes are needed for finding sunlight information; longitudes, for relating sun times to clock times.

In FIG. 3, the depicted horizon 33A is 0.83° below the center of the circle 32A, in order to account for an average effect of air refraction on observing sunrise and sunset. Letters S and N at two ends of the depicted horizon indicate south and north directions, respectively. East and west directions on the depicted horizon coincide near the center of the circle 32A but are not labeled. The depicted boundaries of civil, nautical, and astronomical twilights 34-1A, 34-2A, and 34-3A are parallel to the depicted horizon 33A and 6°, 12°, and 18°, respectively, below the center of the circle 32A.

In FIG. 3, the uniform angle scale 35A, representing angular height over of the horizon or direction, is graduated symmetrically, on the perimeter of the circle 32A, starting from the highest point over the depicted horizon 33A.

In FIG. 3, each graduation of the scale 36-1A reads approximate, maximum available solar energy, in watts per square foot, corresponding to the sun's angular height at the same distance from the depicted horizon 33A as said graduation. The scale 36-2A is uniform from 0 value for the sun's angular height 0° to unity value for the sun's angular height 90°. The approximate, maximum available solar energy can be found from books on solar energy Illustrated in FIG. 3A, the base 30-2A has a pastel system of lines 37-2, which appear uncrowded, consisting of lines parallel to the depicted horizon 33A and elliptical lines. These elliptical lines have major axes perpendicular to the depicted horizon 33A, centered on the center of circle 32A, and equal in length to the diameter of 32A. These elliptical lines give the sun's direction, as will be shown in an example. Numbers 38 for the elliptical lines are projected straight down from the uniform angle scale 35A onto the depicted horizon 33A.

Figure 5:
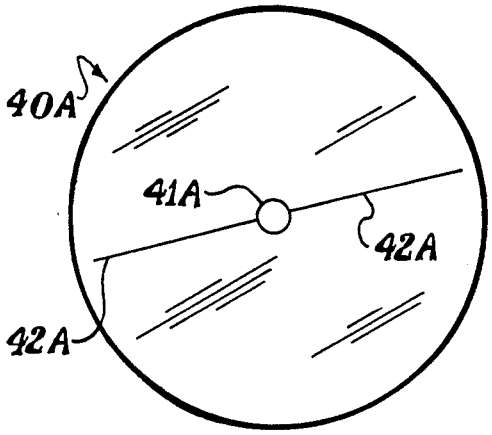
FIG. 5 is a plan view of a minor dial 40A of the device A.
Figure 4:
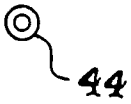
FIG. 4 is a plan view of a washer 44 of the device A.

Illustrated in FIG. 5, the minor dial 40A has a round hole 41A to fit around the washer 44 in FIG. 4 and has a nonuniform angle scale 42A, graduated on a straight line radial from the center of the round hole 41A. The numbers and graduations, shown in FIG. 1, of the nonuniform angle scale 42A can be made in the same manner as those of numbers 38 and associated graduations in FIG. 3A.

Figure 6:
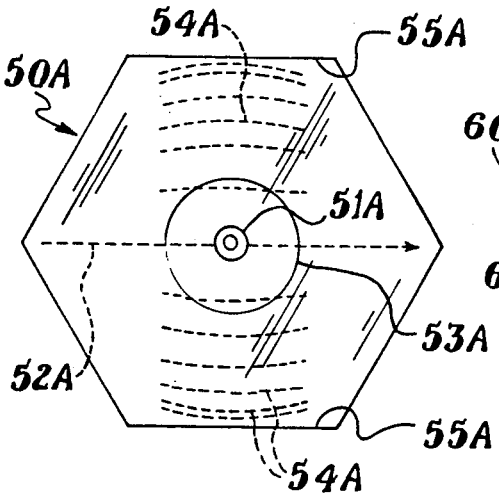
FIG. 6 is a plan view of a major dial 50A of the device A.

In FIG. 2, the major dial 50A has a tapered round hole 51A, which matches with the neck of the flat-head screw 80A so that the top surface of the major dial is flush with the flat-head of the flat-head screw. In FIG. 1, the major dial 50A has a straight line 52A, radial from the center of the tapered round hole 51A, representing a depicted earth's axis of rotation; a date scale 53A, labeled with dates on a circle centered around the tapered round hole 51A; and a time scale 54A consisting of elliptical lines and labels of am and pm hours and duration hours between am and pm hours. In FIG. 6, the major dial has two edges 55A, parallel to the depicted earth's axis of rotation 52A. The date scale may also be labeled with sundial corrections, in minutes, adjacent to and correlated with the dates.

Sundial corrections and the sun's declination, referred to in the next paragraph, can be found from books on astronomy.

In FIGS. 1 and 6, the date scale 53A is made according to the sun's declination, which is zero degree about March 20 and September 22 and of maximum magnitude about June 21 and December 21. In FIG. 1, with the depicted earth's axis of rotation 52A parallel to the depicted horizon 33A, then each line vertical to 33A and through a date on 53A reads 90 degrees minus the corresponding date's declination, in magnitude, on the uniform angle scale 35A. The dates on 53A are in a clockwise order with the northern spring equinox, March 20, at 12 o'clock position. Such an arrangement of dates on 53A requires the depicted horizon 33A to be oriented with S for south on the left and N for north on the right of 33A.

In FIGS. 1 and 6, the time scale 54A can be made in the same manner as the elliptical lines in FIG. 3A but is corresponding to numbers of multiples of 15, instead of multiples of 10 of numbers 38 in FIG. 3A. The major axes of the elliptical lines of the time scale are on the depicted earth's axis of rotation 52A.

Figure 7:
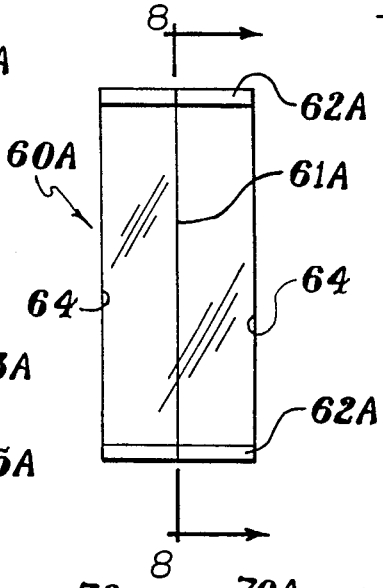
FIG. 7 is a plan view of a sun-path slider 60A of the device A.
Figure 8:
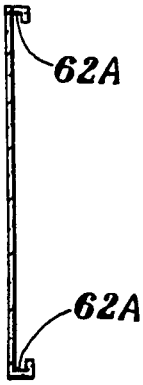
FIG. 8 is a side elevation view of the sun-path slider 60A.

Illustrated in FIG. 7, the sun-path slider 60A has a straight line 61A representing a depicted sun's daily path. FIG. 8 is a side elevation view taken on line 8—8 of FIG. 7. In both of these figures, the sun-path slider has a pair of end channel means 62A, perpendicular to the straight line 61A, for fitting on the two edges 55A of the major dial 50A, so that the sun-path slider is slidable on the major dial. In FIG. 7, the sun-path slider 60A has two edges 64 parallel to 61A.

Figure 9:
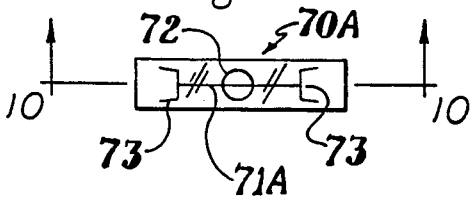
FIG. 9 is a plan view of a sun-position slider 70A of the device A.
Figure 10:
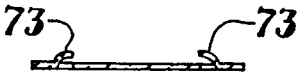
FIG. 10 is a side elevation view of the sun-position slider 70A.

Illustrated in FIG. 9, the sun-position slider 70A has a line 71A, perpendicular to the depicted sun's daily path 61A, for indicating the sun's position on 61A and has a circle 72 for symbolizing the sun. FIG. 10 is a side elevation view taken on line 10—10 of FIG. 9. Illustrated in both of these figures, the sun-position slider 70A has a pair of channel means, flaps 73 cut out and pushed upward, for fitting on the two edges 64 of the sun-path slider 60A, so that the sun-position slider is slidable on the sun-path slider.

Figure 11:
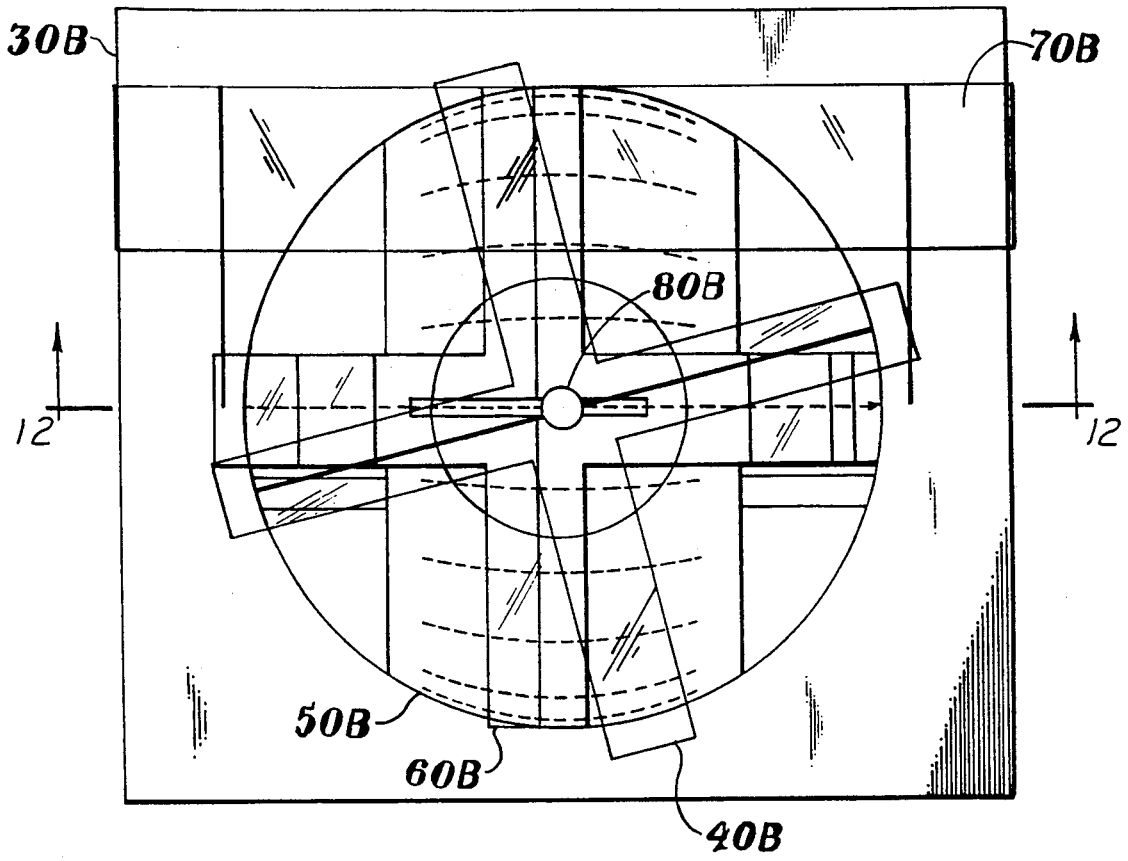
FIG. 11 is a plan view of a device B according to the invention.
Figure 12:
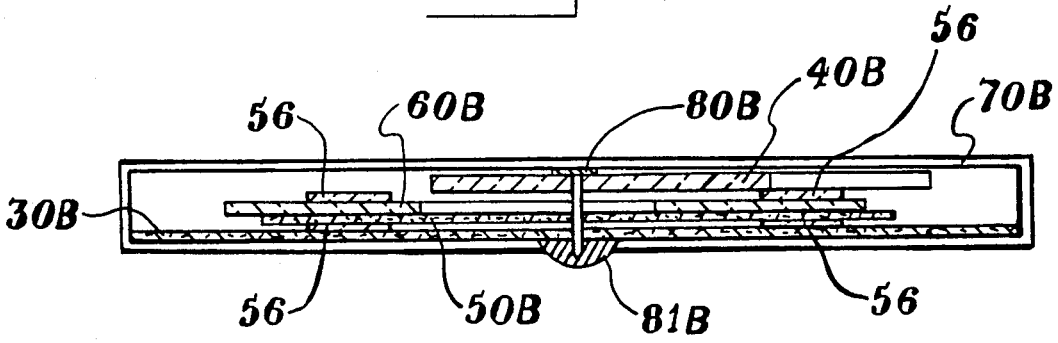
FIG. 12 is a side elevation view of the device B.

FIG. 11 is a plan view of the device B. FIG. 12 is a side elevation view taken on line 12—12 of FIG. 11. Equivalent or identical portions of the device A and the device B are designated with the same number but A for the former and B for the latter.

Figure 13:
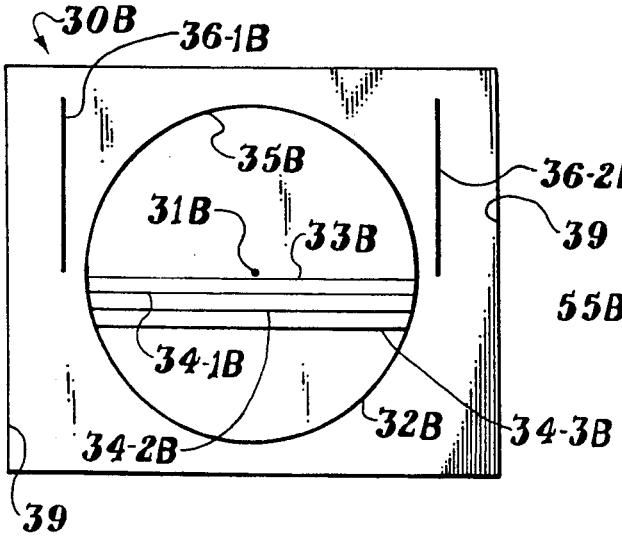
FIG. 13 is a plan view of a base 30B of the device B.
Figure 14:
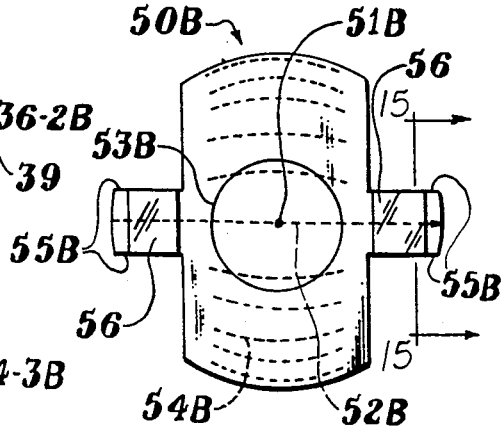
FIG. 14 is a plan view of a major dial 50B of the device B.
Figure 17:
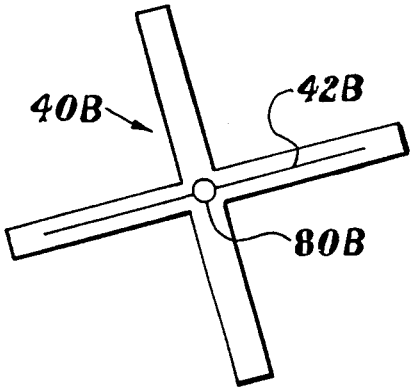
FIG. 17 is a plan view of a minor dial 40B of the device B.
Figure 16:
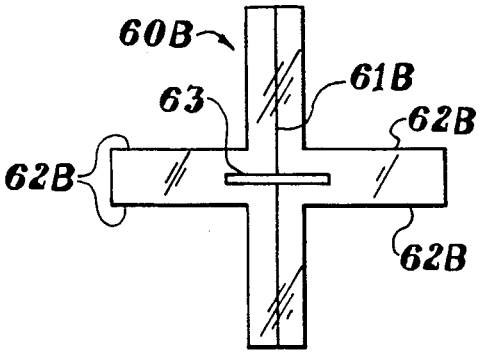
FIG. 16 is a plan view of a sun-path slider 60B of the device B.
Figure 18:
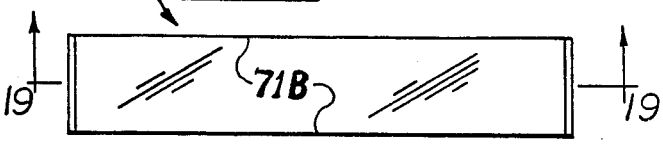
FIG. 18 is a plan view of a sun-position slider 70B of the device B.
Figure 15:
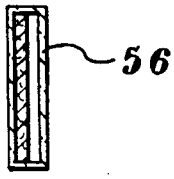
FIG. 15 is a side elevation view of the major dial 50B.
Figure 19:
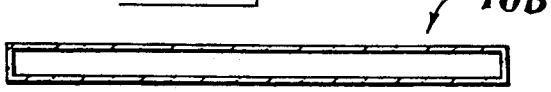
FIG. 19 is a side elevation view of the sun-position slider 70B.

In sequence of assemblage of its components from bottom to top, the device B comprises a base 30B in FIG. 13, a major dial 50B in FIGS. 14 and 15, a sun-path slider 60B in FIG. 16, a minor dial 40B in FIG. 17, and a sun-position slider 70B in FIGS. 18 and 19. All these components of the device B are also indicated in FIGS. 11 and 12. The device B comprises further a fastener consisting of a thumb tack or tie tack 80B in FIGS. 11 and 12 and a pin clutch means 81B in FIG. 12. The pin clutch means may be an expedient, such as a wood board.

For the device B, the base and the major dial can be made from paper, imprinted with needed markings, pasted on cardboard; the minor dial, the sun-path slider, and the sun-position slider can be made from thin, transparent sheets. The nonuniform angle scale of the minor dial can be on a narrow strip of paper, so that the minor dial is mostly transparent. Then the device B has all graduations, numbers, and labels on paper and only a few straight lines on transparent sheets. It is preferred, however, that the major dial and the minor dial be transparent.

Illustrated in FIG. 12, the thumb tack 80B and the pin clutch means 81B hold together the base 30B, the major dial 50B, and the minor dial 40B, at the center of these three components.

Illustrated in FIG. 13, the base 30B has a round hole 31B and markings 32B, 33B, 34-1B, 34-2B, 34-3B, 35B, 36-1B, and 36-2B, respectively identical to 32A, 33A, 34-1A, 34-2A, 34-3A, 35A, 36-1A, and 36-2A, of the base 30A. The base 30B has two parallel edges 39, perpendicular to the depicted horizon 33B.

Illustrated in FIG. 14, the major dial 50B has a round hole 51B and markings 52B, 53B, and 54B respectively identical to 52A, 53A, and 54A of the major dial 50A.

The major dial 50B has a cross-like shape; two arms with two pairs of parallel edges 55B, parallel to the depicted earth's axis of rotation 52B; and two channel means, flat loops 56 on these two arms. The flat loops 56 are also indicated on a different scale in FIGS. 12 and 15, which is an elevation view taken on line 15-15 of FIG. 14.

Illustrated in FIG. 16, the sun-path slider 60B has a cross-like shape; a straight line 61B representing a depicted sun's daily path; and a slit 63, perpendicular to 61B. Two arms of the sun-path slider 60B have two pairs of parallel edges 62B, perpendicular to the straight line 61B, and just fit through the flat loops 56 of the major dial 50B in FIG. 14, so that the sun-path slider is slidable on the major dial. The slit 63 prevents the thumb tack from interfering with the sliding.

Illustrated in FIG. 17, the minor dial 40B is cross shaped, in order not to totally cover up the major dial below or be covered by the sun-position slider above. Scale 42B of the minor dial 40B is identical to scale 42A of the minor dial 40A. The minor dial 40B has at its center the thumb tack 80B and has the flat head of this thumb tack taped smooth.

Illustrated in FIG. 18, the sun-position slider 70B has parallel edges 71B, for indicating the sun's position on the depicted sun's daily path 61B in FIG. 16. Illustrated in FIG. 19, an elevation view taken on line 19—19 of FIG. 18, is a flat loop formed by the sun-position slider. The flat loop fits on the parallel edges 39 of the base 30B, so that the sun-position slider is slidable on the base 30B and around the rest of the device B. Edges 71B are parallel to the depicted horizon 33B.

OPERATION AND EXAMPLE

In the operation of the device, the depicted earth's axis of rotation on the major dial is rotated to an angle, on the base, equal to the latitude of interest, and the sun-path slider is slid so that the depicted sun's daily path goes through the date of interest on the major dial, then the device depicts an elevation view of the earth's axis of rotation and the sun's daily path on the celestial sphere, for the latitude and date of interest. The sun's positions on the depicted horizon and at the depicted boundaries of the twilights give on the time scale of the major dial the times of sunrise and sunset and the times of the beginnings and endings of the twilights. A vertical line up from the sun's position on the depicted horizon reads on the base the angle, for the directions of sunrise and sunset, from a north-south line.

For the time of interest, the sun's position on the depicted sun's daily path is indicated preferably with the help of the sun-position slider, which is to be slid according to the time scale on the major dial. A horizontal line through the sun's position reads on the base the sun's angular height over the horizon, and also reads on the base solar energy quantities. The minor dial is rotated so that its nonuniform angle scale on a straight line meets the circle on the base at the sun's angular height. Then a vertical line down from the sun's position reads on the nonuniform angle scale the sun's direction from the north-south line. The time refers to sun time or sundial time, which is at 12 o'clock when the sun is highest in a day and in the north-south direction. Sun times can be translated into clock times, based on sundial correction and longitude.

The just described horizontal line and the vertical line from the sun's position can be visually instead of actually drawn, aided by a ruler or the systems of lines 37-1 in FIG. 3.

The following example, common to both the device A and the device B, explains basic operations of the invention. Having overlaying, transparent components, these devices are preferred to be viewed straight, not at a slant angle, in order to minimize parallax between overlaying components. For clarity and simplicity, figures for the examples show only a large circle representing the depicted celestial sphere, a concentric smaller circle representing the date scale, and several lines to be identified.

Figure 20:
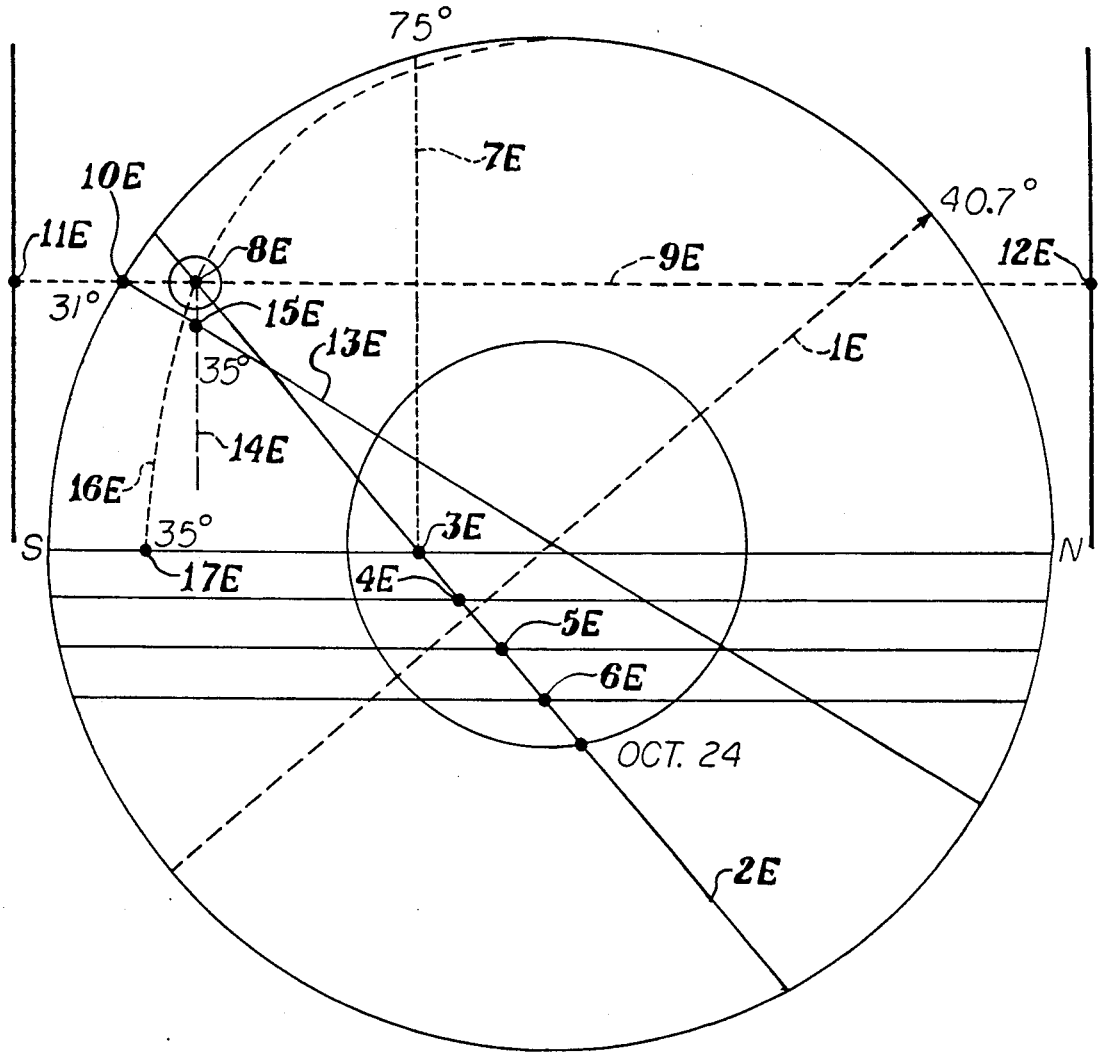
FIG. 20 is for an operating example.

An example, illustrated in FIG. 20, is to find sunlight information for New York City at latitude 40.7° north, on United Nations Day, October 24, and at 10 am and 2 pm, sun time.

The depicted earth's axis of rotation 1E on the major dial is rotated to 40.7° over the depicted horizon on the north, indicated by letter N. Straight line 2E, representing the depicted sun's daily path, on the sun-path slider is slid to October 24 on the major dial.

On this depicted sun's daily path, the sun's position 3E on the depicted horizon reads on the major dial these times: sunrise 6:35 am, sunset 5:25 pm, and duration from sunrise to sunset 10 hours 50 minutes. The sun's positions 4E, 5E, and 6E on the depicted boundaries of the twilights read on the major dial these times, respectively: the beginning of civil twilight 6:10 am, ending of civil twilight 5:50 pm, and duration from this beginning to ending 11 hours 40 minutes; and so on for nautical and astronomical twilights. A vertical line 7E up from the sun's position on the depicted horizon reads on the base the sun's direction 75° from the north-south line. Since this sun's position is on the left side of the depicted horizon marked with S for south, the direction of sunrise is 75° east from south and the direction of sunset, 75° west from south.

These directions can also be found by using the minor dial. When the nonuniform angle scale of the minor dial is rotated horizontal, the sun's position 3E on the depicted horizon reads on this angle scale 75° from the north-south line, the same as that just stated.

The sun's position on the depicted sun's daily path 2E and on the 10 am and 2 pm line of the major dial is at point 8E. A horizontal line 9E through the sun's position 8E reads on the uniform angle scale on the base the sun's angular height 31° at point 10E.

This horizontal line 9E also reads on the base an approximate, maximum available solar energy 81 watts per square foot at 11E and an angle factor for solar energy reduction 0.51 at 12E. This factor is for a level ground or surface with the sun's angular height 31° from the surface. Solar energy on this surface is the product of 81 watts per square foot and 0.51, if sunlight is unhindered. For any other interested angular height of the sun from a surface, an angle factor for solar energy reduction can be read on the base from a horizontal line through a point that indicates, on the uniform angle scale of the base, the interested angular height.

The minor dial is rotated so that its nonuniform angle scale, straight line 13E meets the circle on the base at point 10E that indicates the sun's angular height 31°. A vertical line 14E down from the sun's position 8E at 10 am and 2 pm reads at point 15E on the nonuniform angle scale 13E the sun's direction 35° from the north-south line. Since the sun is on the left side of the horizon marked S for south, the sun's direction is 35° east of south at 10 am and 35° west of south at 2 pm.

Instead of the minor dial, the systems of lines 37-2 in FIG. 3A can be used for finding the sun's direction. In FIG. 20, an elliptical line 16E going through point BE is visually interpolated between elliptical lines of 37-2. The elliptical line 16E meets the depicted horizon at point 17E, which reads, from numbers for the systems of lines 37-2, angle 35° for the sun's direction from the north-south line.

In general, sun time plus sundial correction plus longitude correction gives standard time. The sundial correction for October 24 is minus 16 minutes. The longitude correction is minus or plus 4 minutes for each degree longitude east or west, respectively, of the standard meridian of the time zone in question. New York at longitude 74° west is 1° east of its standard meridian 75° west, of the time zone in question, the Eastern Standard Time. Then the longitude correction is minus 4 minutes. The total correction is minus 20 minutes. The 10 am and 2 pm sun times becomes 9:40 am and 1:40 pm, Eastern Standard Times. The sun time of sunrise 6:35 am stated earlier becomes 6:15 am, Eastern Standard Time and so on.

Sundial corrections can be found from astronomical almanacs and may be labeled next to dates of the date scale of the major dial.

I claim:

1. A device, comprising a base, having a flat surface modified with a hole through its center;

a depicted celestial sphere, represented by a circle centered on the hole;

a depicted horizon, represented by a straight line nearly bisecting the circle;

and uniform angle scale, comprising uniformly graduated angles on the perimeter of the circle;

a flat major dial, rotatably surmounted on the base; having a hole through its center;

a depicted earth's axis of rotation, represented by a straight line radial from the center of the hole through the major dial;

a date scale, comprising nearly, uniformly graduated dates, on a circle, centered on the hole through the major dial;

and a time scale, comprising elliptical lines, labeled with time, with major axes on the depicted earth's axis of rotation;

a fastener for rotatably holding the major dial and the base;

and a flat, transparent sun-path slider, slidably surmounted on the major dial, for sliding along the depicted earth's axis of rotation on the major dial; and the sun-oath slider having thereon a depicted sun's daily path, represented by a straight line perpendicular to the depicted earth's axis of rotation.

2. The device of claim 1 wherein the major dial is transparent.

3. The device of claim 1 wherein the major dial has the dates of its date scale arranged clockwise, the March 20 at 12 o'clock position.

4. The device of claim 1 wherein the major dial has sundial corrections labeled next to the dates of the date scale.

5. The device of claim 1 further comprising a flat minor dial, rotatably held by the fastener; and the minor dial having a hole through its center;

and a nonuniform angle scale, graduated on a straight line radial from the center of the hole through the minor dial.

6. The device of claim 5 wherein the nonuniform angle scale is graduated at the finer than 15-degree angle intervals and labeled at 15-degree angle intervals.

7. The device of claim 1 wherein the fastener has a flat head;

the major dial has the flat head of the fastener mounted flush with the upper surface of the major dial;

and two edges, parallel to the depicted earth's axis of rotation;

and the sun-path slider has a pair of end channel means, for the sun-path slider to slide on the two edges of the major dial.

8. The device of claim 7 further including a flat, transparent minor dial, between the base and the major dial, rotatably held by the fastener; and the minor dial having a hole through its center;

and a nonuniform angle scale, graduated on a straight line radial from the center of the hole through the minor dial.

9. The device of claim 8 wherein the hole through the center of the minor dial has a diameter larger than the diameter of the fastener;

and the device of claim 8 further comprising a washer, which fits between the hole through the minor dial and the fastener, the washer being thicker than the minor dial.

10. The device of claim 7 wherein the sun-path slider has two edges parallel to the depicted sun's daily path; and the device of claim 7 further comprising a flat, transparent sun-position slider, which is slidably attached to the sun-path slider, and the sun-position slider having a pair of channel means, for the sun-position slider to slide on the two edges of the sun-path slider;

and a line to indicate the sun's position on the depicted sun's daily path.

11. The device of claim 10 wherein the line to indicate the sun's position is perpendicular to the depicted sun's daily path.

12. The device of claim 10 wherein a circle, for symbolizing the sun's position on the depicted sun's daily path, is imprinted on the sun-position slider.

13. The device of claim 1 wherein the major dial has a cross-like shape;

two arms, parallel to the depicted earth's axis of rotation;

and two channel means, one each on the two arms of the major dial;

and the sun-path slider has a cross-like shape;

a slit, perpendicular to the depicted sun's daily path;

and two arms, perpendicular to the depicted sun's daily path and fitting through the and two channel means on the major dial.

14. The device of claim 13 further comprising a flat, minor dial, which is mostly transparent, rotatably held by the fastener; and the minor dial having a hole through its center;

and a nonuniform angle scale, graduated on a straight line radial from the center of the hole through the minor dial.

15. The device of claim 13 wherein the base has two parallel edges, perpendicular to the depicted horizon; and the device of claim 13 further comprising a flat, transparent sun-position slider, which forms a flat loop wrapped around the device, for sliding along the two parallel edges of the base, and the sun-position slider having two edges parallel to the depicted horizon.

16. The device of claim 1 wherein the base has lines, parallel to the depicted horizon, to represent depicted boundaries of civil, nautical, and astronomical twilights.

17. The device of claim 1 wherein the base has scales for solar energy quantities, correlatable with the sun's angular height.

18. The device of claim 1 wherein the base has legs underneath said base for resting the device stably on a fairly flat surface.

19. The device of claim 1 wherein the base has a system of lines parallel to the depicted horizon and elliptical lines, each of the elliptical lines being labelled with an appropriate angle, and each of the elliptical lines having a major axis which is perpendicular to the depicted horizon.

20. The device of claim 1 wherein the base has a system of lines parallel to and lines perpendicular to the depicted horizon.

21. The device of claim 20 wherein the system of lines parallel to the lines perpendicular to the depicted horizon comprise a fabric which furnishes the lines.

* * * * *

UNITED STATES PATENT AND TRADEMARK OFFICE

CERTIFICATE OF CORRECTION

PATENT NO. : 5,186,630

DATED : February 16, 1993

INVENTOR(S) : Li Chiu Tien

It is certified that error appears in the above-indentified patent and that said Letters Patent is hereby corrected as shown below:

In column 9, line 3, please change "BE" to --8E--;

line 34, after "and" please insert --a--;

line 53, please change "oath" to --path--; and line 60, please change ", the" to --, with--.

In column 10, line 5, after "at" please delete "the".

Signed and Sealed this

Eighth Day of February, 1994

Bruce Lehman

*Attest:*

BRUCE LEHMAN

*Attesting Officer*

*Commissioner of Patents and Trademarks*